US008181961B1

(12) United States Patent
Hall

(10) Patent No.: US 8,181,961 B1
(45) Date of Patent: May 22, 2012

(54) IN-TUBE PUZZLE

(75) Inventor: Louis Hall, Mendota Heights, MN (US)

(73) Assignee: Louis J. Hall, Mendota Heights, MN (US)

( * ) Notice: Subject to any disclaimer, the term of this patent is extended or adjusted under 35 U.S.C. 154(b) by 198 days.

(21) Appl. No.: 12/701,229

(22) Filed: Feb. 5, 2010

Related U.S. Application Data

(60) Provisional application No. 61/156,234, filed on Feb. 27, 2009.

(51) Int. Cl.
*A63F 9/08* (2006.01)

(52) U.S. Cl. ..... 273/157 R; 273/156; 273/157 A

(58) Field of Classification Search ..... 273/157 R, 273/156, 153 R, 157 A; 446/88, 160; 434/372, 434/393, 373
See application file for complete search history.

(56) References Cited

U.S. PATENT DOCUMENTS

| | | | | | |
|---|---|---|---|---|---|
| 729,174 | A * | 5/1903 | Hill | 273/156 |
| 1,020,031 | A * | 3/1912 | Fahndrich | 273/153 R |
| 1,471,943 | A * | 10/1923 | Chambers | 273/157 R |
| D138,214 | S * | 7/1944 | Miller | D21/478 |
| 2,475,306 | A * | 7/1949 | Beder | 273/157 R |
| 2,545,706 | A * | 3/1951 | Rosenberg | 446/160 |
| 2,730,827 | A * | 1/1956 | Patterson | 446/88 |
| 3,704,892 | A * | 12/1972 | Moravick et al. | 273/157 R |
| 3,845,959 | A * | 11/1974 | Kosarek | 273/153 S |
| 3,900,985 | A * | 8/1975 | Yoen | 446/124 |
| D247,516 | S * | 3/1978 | Root | D21/479 |
| 4,424,971 | A * | 1/1984 | Clark | 273/153 S |
| 4,432,548 | A * | 2/1984 | Kassan | 273/153 S |
| 4,494,756 | A * | 1/1985 | Winer | 273/156 |
| 4,556,395 | A * | 12/1985 | Schultz | 446/160 |
| 4,804,187 | A * | 2/1989 | Cramer | 273/157 R |
| 4,874,176 | A * | 10/1989 | Auerbach | 273/157 R |
| 5,310,183 | A * | 5/1994 | Glikmann | 273/153 S |
| 6,513,808 | B2 * | 2/2003 | Fang | 273/153 S |
| 2010/0264584 | A1 * | 10/2010 | Maddock | 273/156 |

* cited by examiner

*Primary Examiner* — Steven Wong

(57) ABSTRACT

A self-contained three-dimensional puzzle game that has a plurality of free-floating individual puzzle pieces (6) enclosed within a transparent enclosure (8). Puzzle is solved by using a wand (1) to move the individual puzzle pieces and forming the three dimensional solution. Wand is comprised of a rod, which extends through a small hole (4) in the enclosure. One embodiment has the three-dimensional subject solution covered with image graphics (10) so that when the individual pieces are manipulated into the correct positions they bring about an overall composition.

4 Claims, 3 Drawing Sheets

IN-TUBE PUZZLE

CROSS REFERENCE TO RELATED APPLICATIONS

This application claims the benefit of provisional patent application Ser. No. 61/156,234 filed 2009 Feb. 27 by the present inventor.

FEDERALLY SPONSORED RESEARCH

Nonapplicable

SEQUENCE LISTING OF PROGRAM

Nonapplicable

BACKGROUND

This application relates to hand-held three-dimensional game puzzles.

Field of Classification Search 273/153

PRIOR ART

| U.S. Pat. No. Documents | | | |
|---|---|---|---|
| 4,378,117 | August 1983 | Rubik | 273/153/S |
| 7,306,225 | December 2007 | Lu, Yi | 273/153/S |
| 4,949,969 | August 1990 | Johnson, Harvey | 273/153/S |

Most interconnected or self-contained game puzzles do not allow the individual pieces to become separated and lost; this is a good benefit but it has an unfortunate consequence. Like the Rubik's cube game U.S. Pat. No. 4,378,117 and Johnson's cylindrical puzzle U.S. Pat. No. 4,949,969, in order to start a new game session after the puzzle is solved; the user must take-apart or scramble the individual pieces one at a time. This willful manipulation of the pieces is not random. This process of scrambling the individual pieces is often subjective and requires a third party to truly scramble the pieces for an objective challenge.

Scrambling the puzzle pieces in interconnected puzzles is frequently a slow process and takes away from playing the game.

Puzzle pieces with many interconnected individual parts and multiple seams present difficulties in keeping the components free of harmful germs and unwanted friction-causing grit.

Most interconnected puzzles, like the block games, consist of individual piece blocks that move relative to one another to obtain various combinations, U.S. Pat. No. 7,306,225. The manipulating of the moveable pieces causes friction between puzzle pieces, as well as the internal central core components. Over time, the friction can cause the user experience to diminish due to the uneven affects of worn components.

Many interconnected game puzzles, like the Rubik's cube, are limited in their size and scalability. The complex inner mechanics and the need to touch each exterior piece with ones fingers prevent the overall size of the puzzle from being very small and still usable.

Many interconnected game puzzles require full dexterity and nimbleness of multiple fingers to grab each piece and move it in order to obtain the solution, this physical requirement limits who can effectively play and solve the game.

Many other puzzle games exist but often the individual pieces are lost or are scratched and misshapen over time and unrecognizable.

ADVANTAGES

When starting a new game session, one simply pulls the wand back out of the interior of the enclosure and shakes the puzzle to scramble pieces, and then one is free to reassemble and solve it from this truly random state. The puzzle pieces easily fall into a random pattern during a brisk shake and allow the game session to begin quickly.

The container, which I contemplate to have few or no seams, provides an easy-to-clean surface and which deters harmful germ contact with users; this is desirable for communal-use settings.

The free-floating individual puzzle pieces are contained, one never loses the pieces, yet they do not excessively rub against one another causing friction and harmful wear since they are not tightly interconnected and tethered.

The handle of the puzzle can be designed large, small or flat for ease-of-use and so does not require the full-use of fingers. This accessibility enables the puzzle to be used to encourage rehabilitative and therapeutic activity for physical therapy treatment of hands, fingers and wrists; stationary-patient geriatric care as well as cognitive recovery.

This simple free-floating puzzle piece design, which does not include the large interconnected core found in interconnected cube puzzles, can be produced in a very small size, less than 2 inches high, and still be functional. Alternatively, the puzzle size can also be created in a very large size, larger than 14 inches high and with many individual pieces. This scalability supports a broad family of puzzles.

By varying the number of individual pieces and the image on the puzzle this toy can be made specifically for targeted age groups and capabilities. The puzzle image could be a constellation, light spectrum or complex pattern so as to impart stimulating and educational value through the image.

Embodiments of this toy can be made where both the puzzle shape and puzzle-images mimic specific subjects; for example, a family of in-tube puzzles can be designed such that the 3d puzzle subject inside the enclosure is dog, bird, boat, dental tooth or some other recognizable shape.

Custom interactive kit-designs are possible as well; the end-cap could be made removable so individuals could hand-make the image graphic on puzzle-subject.

In-tube puzzle can be easily manufactured to accept printing of graphic images on puzzle subject. One can mass-produce a small in-tube puzzle and custom print other business's logo or company name on the puzzle, so they can be used as a promotional vehicle.

The few piece parts of the puzzle, combined with simple tooling requirements and easy construction steps make manufacturing a reasonable undertaking.

SUMMARY

A self-contained puzzle comprising a plurality of individual free-floating puzzle pieces contained within a transparent enclosure, a wand which is used to solve said puzzle by reaching through hole in said transparent enclosure and moving said individual free-floating puzzle pieces and forming the three dimensional solution.

DRAWINGS

FIG. 1 represents a view of an in-tube puzzle, where the puzzle-subject is fully assembled and solved.

FIG. 2 the In-tube puzzle is shown being assembled.

Figure 8:
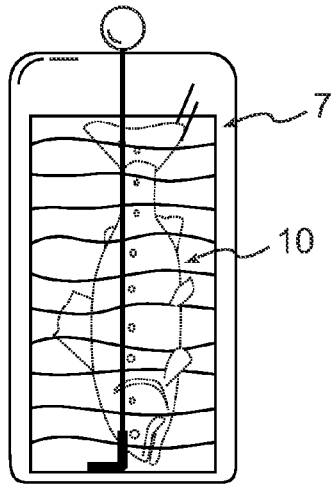

FIG. 8 this side-view of an in-tube puzzle shows a fish image graphic on solved puzzle.

Figure 9:
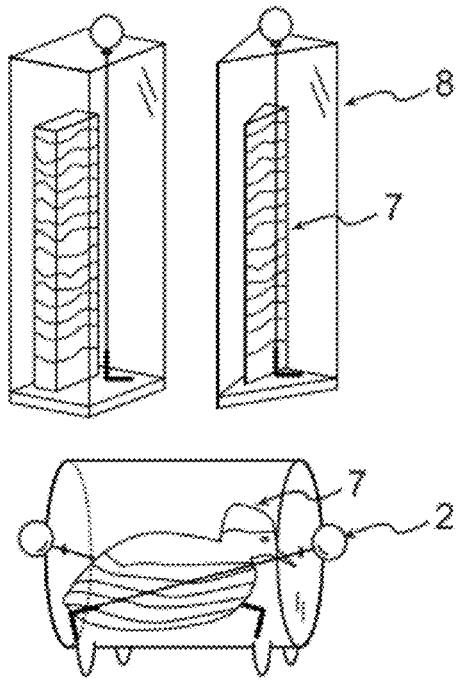

FIG. 9 depicts three embodiments of the in-tube puzzle container shape.

Figure 10:
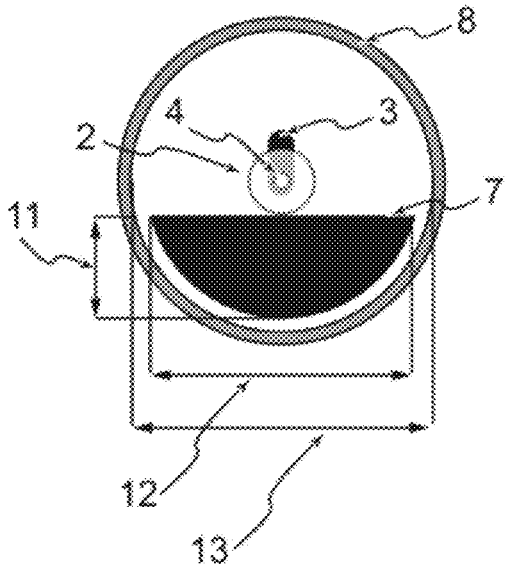

FIG. 10 is an end-view of in-tube puzzle.

Figure 11:
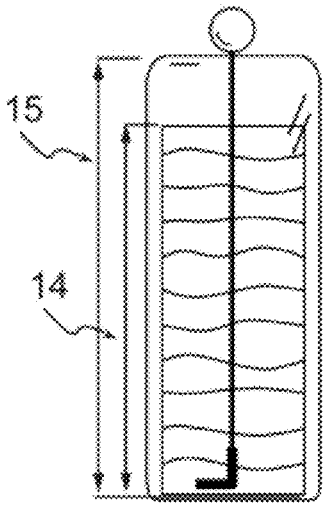

FIG. 11 is side-view of an in-tube puzzle and shows the proportions of the height of the assembled puzzle-subject in relationship to the inside dimensional height of the container.

Figure 12:
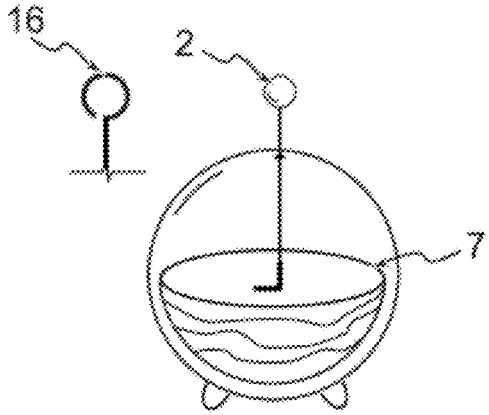

FIG. 12 represents a spherical puzzle embodiment

DRAWING REFERENCE NUMBERS

| | |
|---|---|
| 1. | Wand |
| 2. | Handle of wand |
| 3. | Foot of wand |
| 4. | Hole in tube-enclosure |
| 5. | Curved surface of half cylinder puzzle-subject |
| 6. | Individual puzzle piece |
| 7. | Assembled puzzle-subject |
| 8. | Transparent tube-enclosure |
| 9. | End-cap of enclosure |
| 10. | Image graphic |
| 11. | Radius of half cylinder puzzle-subject |
| 12. | Diameter of half cylinder puzzle-subject |
| 13. | Inside dimensional width of cylindrical tube enclosure |
| 14. | Height of the puzzle-subject |
| 15. | Inside dimensional height of tube enclosure |
| 16. | Alternative wand handle |

DETAILED DESCRIPTION

Figure 1:
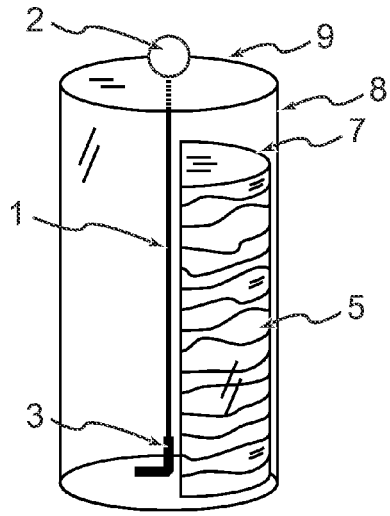

FIG. 1 represents a view of the first embodiment of the in-tube puzzle, where the puzzle-subject 7 has already been assembled within the transparent tube-enclosure 8. Puzzle-subject 7 is comprised of wood or equivalent density material, which is cut, sawed, molded or stamped into a plurality of individual pieces; in this illustration there are fifteen individual puzzle pieces 6 (identified in FIG. 2) stacked upon one another and form the solved puzzle subject 7. The wand 1 is illustrated as fully inserted within transparent tube-enclosure 8, through an axial hole 4 (identified in FIG. 2) in the end-cap of enclosure 9. The handle of wand 2 is shown resting against the outside of the end-cap of enclosure 9, while the foot of wand 3 rests against the inside of the bottom of the transparent tube-enclosure 8. Transparent tube-enclosure 8 is cut or molded from acrylic or equivalent transparent material. The tube-enclosure end-caps 9 can be molded as continuous material or adhered to tube.

Figure 2:
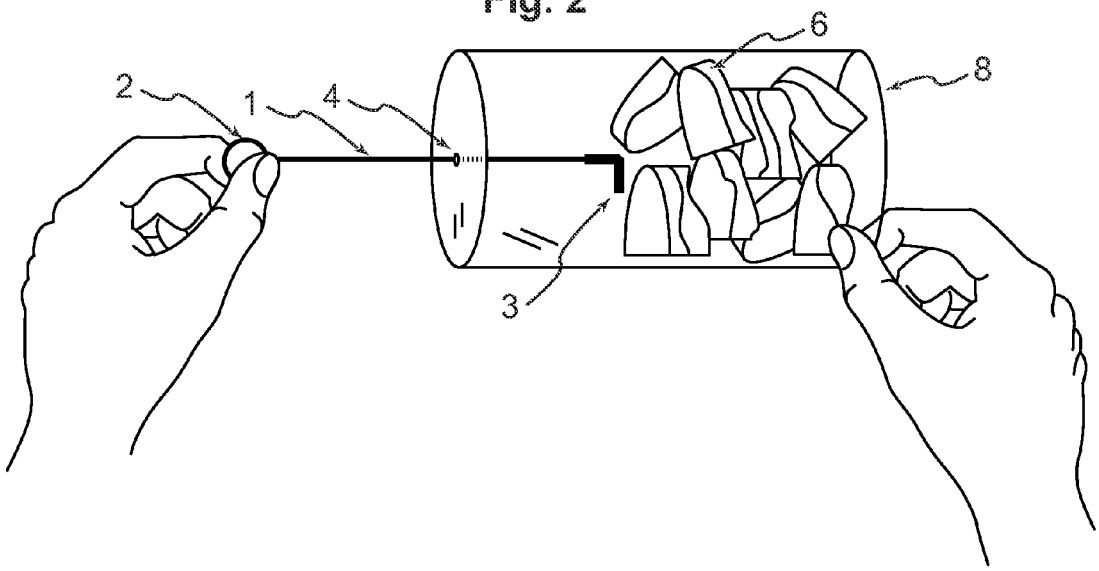

FIG. 2 depicts the in-tube puzzle being solved. Handle of wand 2 is grasped in one hand and wand is used to manipulate the position of the individual puzzle pieces 6 inside the tube. This first embodiment of the in-tube puzzle has the hole 4 in an axial-location of the transparent enclosed tube assembly 8. Hole allows wand to be moved and pivoted to reach majority of interior space of enclosure yet restrictive enough to keep wand foot 3 from being pulled completely out of enclosure.

Figure 3:
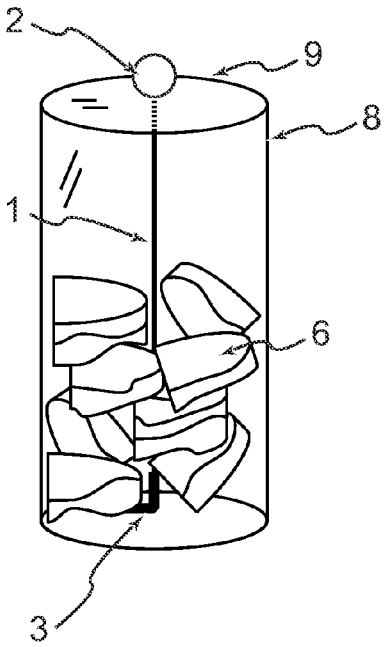
FIG. 3 depicts puzzle scrambled into a random mixture, ready for assembly.

FIG. 3 illustrates the in-tube puzzle in a random scrambled state within tube, ready to be solved. Wand foot 3 is larger than hole 4 in the tube-enclosure; the handle 2 of the wand is outside of the tube, the handle is larger than hole 4 in tube-enclosure. Other embodiments of the puzzle may have removable end-caps that screw-on or snap-on connect, allowing users to create or modify the individual puzzle pieces 6 or the image graphic 10 on the flat side of half cylinder puzzle subject.

Figure 4:
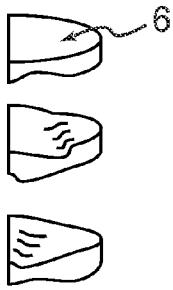
FIG. 4 shows a three individual puzzle pieces that are outside of container.

FIG. 4 shows three individual puzzle pieces 6. They are shown rendered outside of container. Each piece is a unique shape and when assembled and solved correctly, each fit snuggly together into a completed puzzle-subject 7.

Figure 5:
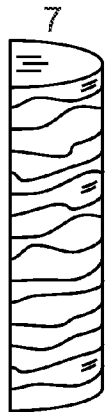
FIG. 5 is an assembled half-cylinder puzzle-subject shown outside of transparent container.

FIG. 5 depicts the puzzle-subject shape 7, as a half-cylinder. It is shown outside of transparent container 8 with fifteen individual pieces fully assembled. The individual puzzle pieces 6 (FIG. 4) have been cut into a generally horizontal shape, or in other words, wider than their height, so that when solved the individual pieces stack and interconnect on top of one another without falling over and fill the interior of the tube space. The amount of space filled by the assembled puzzle-subject 7 is expressed in FIG. 10. I contemplate for this embodiment that the curved side 5 (shown in FIG. 1) and the flat sides of the puzzle-subject 7, would have image graphics 10 (shown in FIG. 8) on the surfaces, however puzzle subjects may not have any images or may have images on all exterior sides.

Figure 6:
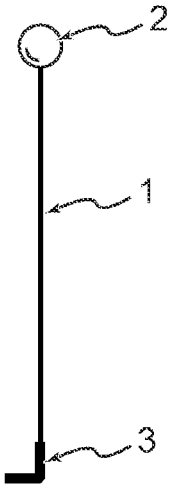
FIG. 6 shows a complete wand outside of enclosure.

FIG. 6, the complete wand 1 is depicted in this figure. I contemplate that in most embodiments the wand is comprised of a foot 3, shaft and handle 2, however the wand 1 could have additional or less components and features. Shaft 1 is a rigid thin material such as a rod of spring steel. Foot of wand 3 is the final portion of the wand 1 shaft bent to an angle and covered with a thick sock-like material made of a rubber or a non-scratching material rigid enough to manipulate the position of individual puzzle pieces; it is screwed-on, adhered or heat-shrunk to shaft of wand 1 for a permanent bond. The spherical-shaped wand-handle 2, which is made of wood, plastic, or equivalent density material is permanently fastened to the metal shaft of wand 1 (FIG. 3) by glue and threads. Other alternative wand designs may have moveable parts that aid in grabbing and moving the individual puzzle pieces 6, or may be fully removable from the enclosure and tethered to the outside of the container.

Figure 7:
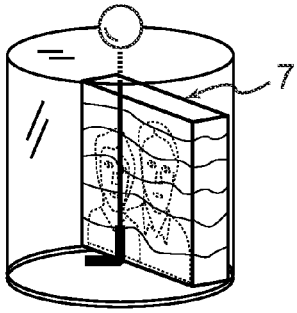
FIG. 7 shows a short embodiment of the in-tube puzzle.

FIG. 7 is an illustration of an alternative embodiment of the in-tube puzzle, although a vertical-orientation, the proportions are shown to be short and wide. The puzzle-subject 7 is cuboid, which provides two flat sides for images 10.

FIG. 8 This side-view of an in-tube puzzle shows a fish image graphic 10 on the assembled puzzle-subject. I presently contemplate that the image is a water-based paint and is screened, printed, or applied as a decal or comparable method. Alternatively, the exterior surface of puzzle subject can be painted or left natural without any image. FIG. 8 shows a seamless top of puzzle.

FIG. 9, three embodiments of the in-tube puzzle transparent tube-enclosure 8 are shown here: triangular prism, cuboid and cylindrical. The puzzle subjects vary in shape as well. The cylindrical enclosure is shown in a horizontal-orientation with feet attached to the underside of the enclosure and a 3D puzzle-subject 7 shaped like a bird. The horizontal-orientated cylindrical puzzle also shows that more than one wand may be incorporated in the design of an in-tube puzzle.

FIG. 10 in this end-view, wand handle 2 is shown transparent, of this first embodiment of the in-tube puzzle, which includes a half-cylinder puzzle-subject 7, demonstrates the size of the puzzle-subject 7 within the transparent tube-enclosure 8. 11 is the radius of the half-cylinder puzzle-subject 7; 12 is the diameter of the half-cylinder puzzle-subject 7 and 13 is the inside diameter of the cylindrical transparent tube. The proportions of the puzzle-subject 7 to the inside area of the tube enclosure is vital to the working of the puzzle. Sufficient space must be preserved within the tube enclosure 8 to allow the individual pieces 6 to adequately move freely about the space and allow for the wand to move them into place. As shown in FIG. 10, the diameter of the half-cylinder 12 of puzzle-subject 7 is approximately 90% of the inside diameter of the cylindrical transparent tube 13. The radius 11 of the half-cylinder puzzle-subject 7 is approximately 50% of the inside diameter of the cylindrical transparent tube 13. However other proportions are workable.

FIG. 11 shows the side-view of an in-tube puzzle and the proportions of the height 14 of the puzzle-subject 7 in relationship to the inside dimensional height of the tube 15. This first embodiment keeps the puzzle-subject height 14 at around 78% of the inside dimensional height of the tube 15.

FIG. 12 shows a spherical container embodiment of the puzzle with a puzzle-subject 7 in a half-sphere shape. This Figure also shows an alternative wand handle 16, the shaft can be extended and coiled into a safe handle without the need of an attached sphere handle.

Operation

When starting a new game session, one simply pulls the wand back out of the container and shakes the puzzle to scramble the pieces, and then tries to solve the puzzle by using the wand to manipulate the position of the individual free-floating pieces and assemble the pieces into the 3D form. Any image on the puzzle acts as a guide to showing where each piece fits. To play again, simply pull wand back and shake puzzle to scramble pieces, and then reassemble.

Additional Alternative Designs

The tube-enclosure 8 can be made with integrated continuous end-caps 9, sealed end-caps or with a removable end-cap. Removable end-caps facilitate kit variations. A kit design could provide pre-cut adhesive labels for home printers; the pre-cut label shapes would match the cut shapes of the individual puzzle pieces, user would then print a family photo on the label then apply images to puzzle-subject 7. Another kit design would leave the puzzle pieces blank so the user can personalize the individual shapes 6 with their own paint or creation; education curriculums could use in-tube kits as an art project that addresses design, color and digital image application.

Presently I contemplate that bright colors and images are on one or several sides of the puzzle-subject 7. The subject of the images 10 can be abstract or literal depictions of familiar subjects like a fish, ship or plant. The choice of colors and shape of the puzzle can be designed to induce an ornamental appearance that is aesthetically pleasing.

As mentioned in the description of FIG. 9, the container may be cylindrical, triangular prism, spherical or cuboid in shape, however, other variations or shapes are very possible and are not limited to the illustrations provided.

I claim:

1. A self contained puzzle, comprising:

a. a plurality of individual free-floating puzzle pieces that are each uniquely contoured in shape and when assembled into their complementary positions form a predetermined three dimensional solution, b. a transparent enclosure that contains said puzzle pieces, said enclosure is of predetermined size and shape such that it provides space needed to move said puzzle pieces into said solution, c. a wand-like instrument, operated and held by hand outside said enclosure, that reaches through a hole in said enclosure and moves said puzzle pieces into said three dimensional solution, said wand-like instrument includes a handle and a foot, said wand-like instrument extends through said enclosure hole, said handle is outside of said enclosure and said foot is inside said enclosure, said handle and foot are larger than said hole in said enclosure thereby restricting said wand-like instrument from being fully removed from said enclosure.

2. The puzzle of claim 1 wherein said hole in said enclosure is coaxial.

3. The puzzle of claim 1 wherein said enclosure is cylindrical.

4. The puzzle of claim 1 wherein said individual free-floating puzzle pieces, have images on their surface.

* * * * *